US009118136B2

(12) United States Patent
Liu et al.

(10) Patent No.: US 9,118,136 B2
(45) Date of Patent: Aug. 25, 2015

(54) LOWER PROFILE CARD EDGE CONNECTOR

(71) Applicant: HON HAI PRECISION INDUSTRY CO., LTD., New Taipei (TW)

(72) Inventors: Feng-Lan Liu, Kunshan (CN); Jian-Kuang Zhu, Kunshan (CN); Zhen-Hua Wang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/257,960

(22) Filed: Apr. 21, 2014

(65) Prior Publication Data

US 2014/0315442 A1 Oct. 23, 2014

(30) Foreign Application Priority Data

Apr. 22, 2013 (CN) ..... 2013 2 2039331

(51) Int. Cl.

| | |
|---|---|
| ***H01R 11/22*** | (2006.01) |
| ***H01R 13/41*** | (2006.01) |
| *H01R 12/72* | (2011.01) |
| *H01R 13/24* | (2006.01) |

(52) U.S. Cl.

CPC ..... *H01R 13/41* (2013.01); *H01R 12/721* (2013.01); *H01R 13/2442* (2013.01)

(58) Field of Classification Search

CPC ..... H01R 13/113; H01R 13/2442

USPC ..... 439/852, 862, 816, 851, 857, 853, 801

See application file for complete search history.

(56) References Cited

U.S. PATENT DOCUMENTS

| | | | | |
|---|---|---|---|---|
| 2013/0045637 | A1* | 2/2013 | Yen et al. | 439/637 |
| 2014/0106622 | A1* | 4/2014 | Yu et al. | 439/630 |
| 2014/0315442 | A1* | 10/2014 | Liu et al. | 439/629 |
| 2015/0087192 | A1* | 3/2015 | Tanigawa et al. | 439/852 |

FOREIGN PATENT DOCUMENTS

| | | |
|---|---|---|
| CN | 202217811 U | 5/2012 |

* cited by examiner

*Primary Examiner* — Phuongchi T Nguyen

(74) *Attorney, Agent, or Firm* — Wei Te Chung; Ming Chieh Chang

(57) ABSTRACT

A card edge connector is used for connecting an electronic card to a printed circuit board and includes an insulative housing and a plurality of conductive terminals retained in the insulative housing. The insulative housing defines a front face, a mounting surface and a receiving slot running through the front face and extending along a longitudinal direction with a key disposed therein. Each conductive terminals defines a contacting arm extending into the receiving slot along a mating direction perpendicular to the longitudinal direction and a soldering portion extending outside of the insulative housing. Each contacting arm defines a free end portion located in the receiving slot and with a contacting portion disposed thereon, the thickness of the free end portion in a vertical direction perpendicular to both the longitudinal direction and the mating direction is smaller than the thickness of other parts of the contacting arm.

16 Claims, 7 Drawing Sheets

LOWER PROFILE CARD EDGE CONNECTOR

BACKGROUND OF THE INVENTION

1. Field of the Invention

The present invention relates to a card edge connector, and more particularly to a lower profile card edge connector.

2. Description of the Related Art

China Pat. No. 202217811U issued on May 9, 2012 discloses a card edge connector including an insulative housing. The insulative housing defines a receiving slot and a first sidewall and a second sidewall located on opposite sides of the receiving slot, and the first and second sidewalls each has a plurality of terminal slots. A plurality of first and second terminals are receiving in the terminal slots of the first and second sidewalls, respectively, and the first and second terminals each defines a retained portion fixed to the insulative housing, an elastic contacting arm extending from the retained portion and a contacting portion located on a free end of the elastic contacting arm. The elastic contacting arm of the second terminal each extends from the retained portion to the contacting portion of the second terminal along a non-fold line and the retained portion is fixed to the terminal slot of the second sidewall. However, the free ends of the contacting potions of the first and second terminals speed a certain space in the receiving slot so that it is not suitable for miniaturization.

Therefore, an improved card edge connector is highly desired to meet overcome the requirement.

BRIEF SUMMARY OF THE INVENTION

An object of the present invention is to provide a card edge connector, and the thickness of the free end of the conductive terminal is less than the thickness of other parts.

In order to achieve above-mentioned object, a card edge connector is used for connecting an electronic card to a printed circuit board and includes an insulative housing and a plurality of conductive terminals retained in the insulative housing. The insulative housing defines a front face, a mounting surface and a receiving slot running through the front face and extending along a longitudinal direction with a key disposed therein. Each conductive terminals defines a contacting arm extending into the receiving slot along a mating direction perpendicular to the longitudinal direction and a soldering portion extending outside of the insulative housing. The contacting arm of each conductive terminal defines a free end portion located in the receiving slot and with a contacting portion disposed thereon, the thickness of the free end portion in a vertical direction perpendicular to both the longitudinal direction and the mating direction is smaller than the thickness of other parts of the contacting arm.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
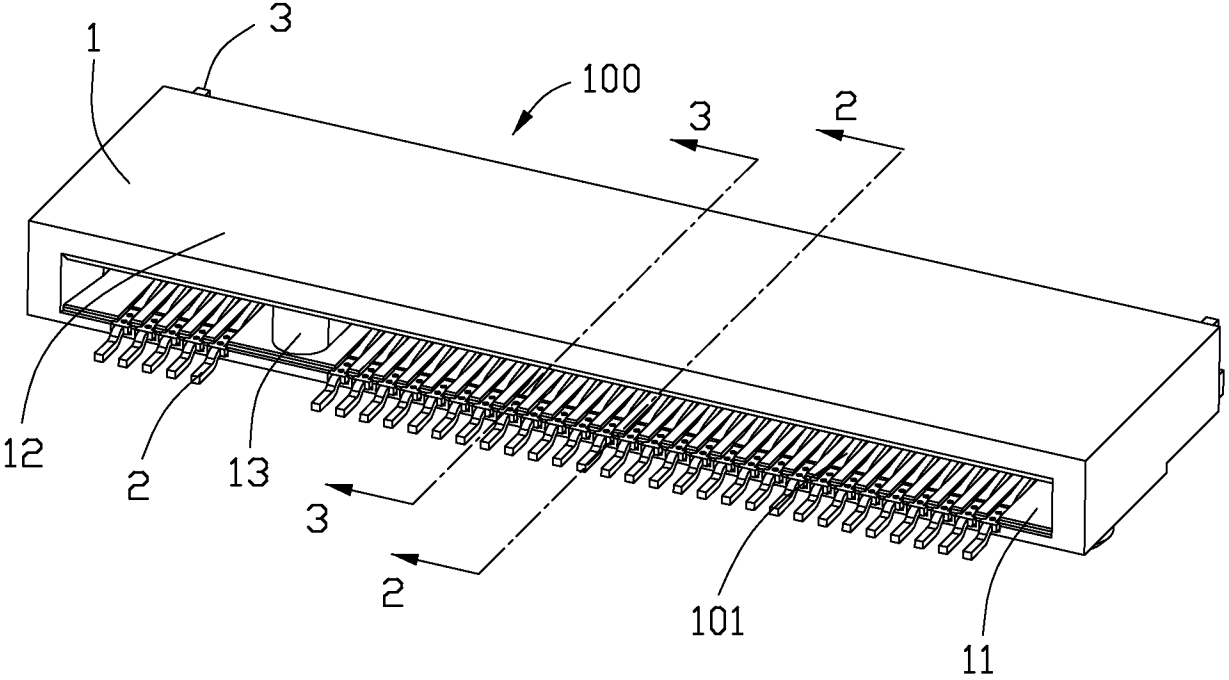
FIG. 1 is a perspective view of a card edge connector in accordance with the present invention.

Reference will now be made to the drawing figures to describe a preferred embodiment of the present invention in detail. Referring to FIG. 1, a card edge connector in accordance with the present invention includes an insulative housing 1, a plurality of conductive terminals 2 retained in the insulative housing 1 and a pair of soldering members 3 located on two sides of the conductive terminals 2. The insulative housing 1 defines a receiving slot 101 running through the front face of the insulative housing 1 and extending along a longitudinal direction, a first sidewall 11 and a second sidewall 12 located on opposite sides of the receiving slot 101 and a key 13 disposed in the receiving slot 101 to prevent an incorrect electronic card inserted into the card edge connector. It is conducive to improve the welding strength of the card edge connector 100 to install the soldering members 3.

Figure 2:
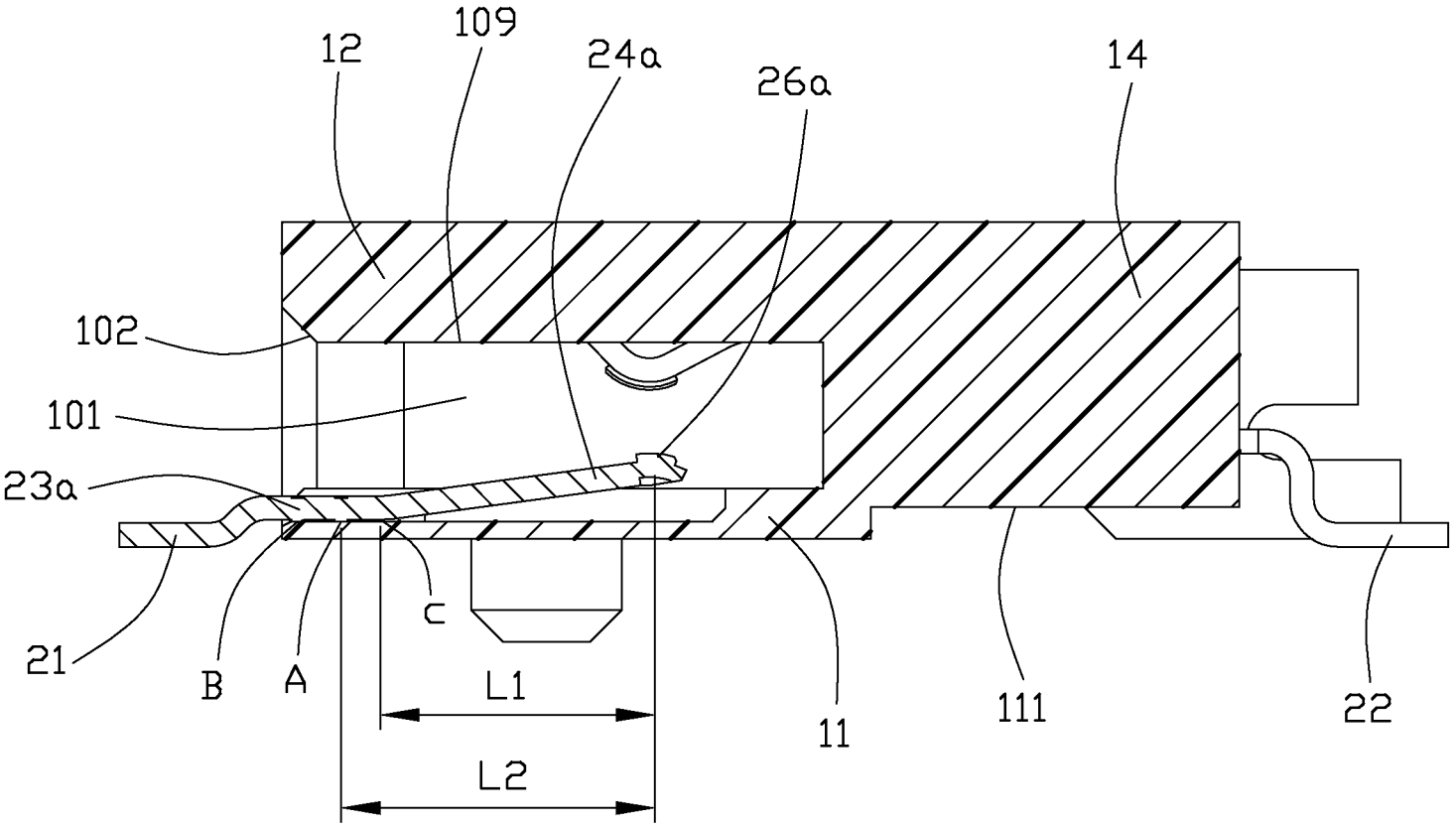
FIG. 2 is a cross-section view of the card edge connector taken along line 2-2 of FIG. 1.
Figure 3:
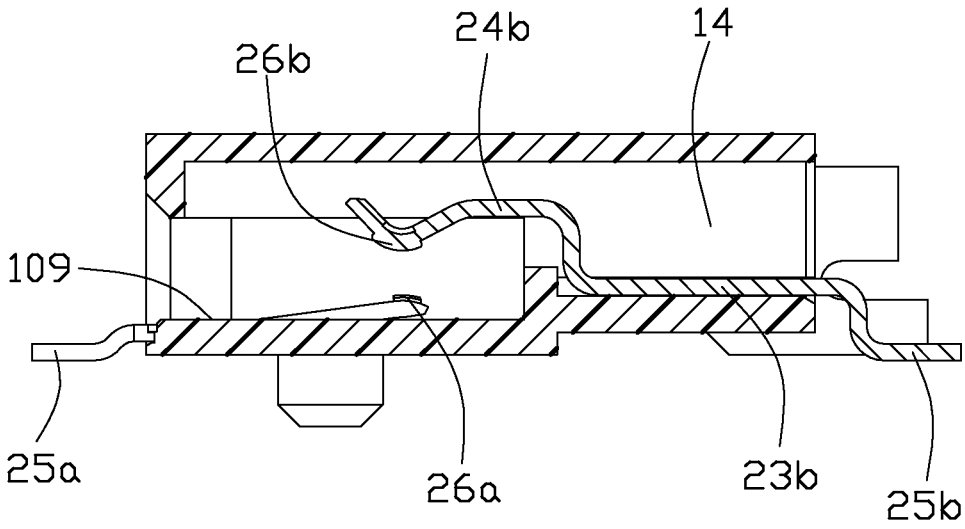
FIG. 3 is a cross-section view of the card edge connector taken along line 3-3 of FIG. 1.
Figure 4:
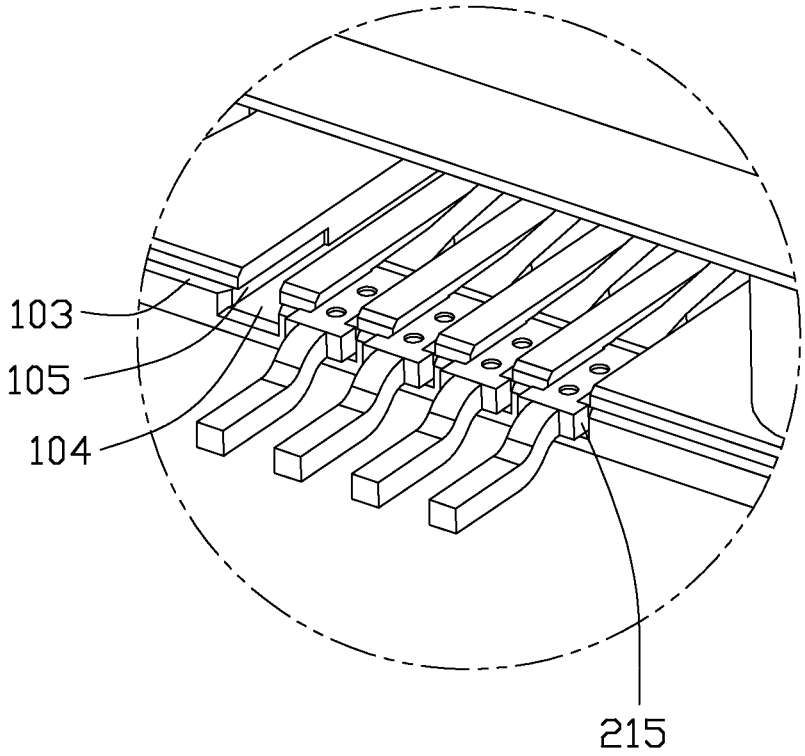
FIG. 4 is an enlarged perspective view of a part of the card edge connector shown in FIG. 1.
Figure 5:
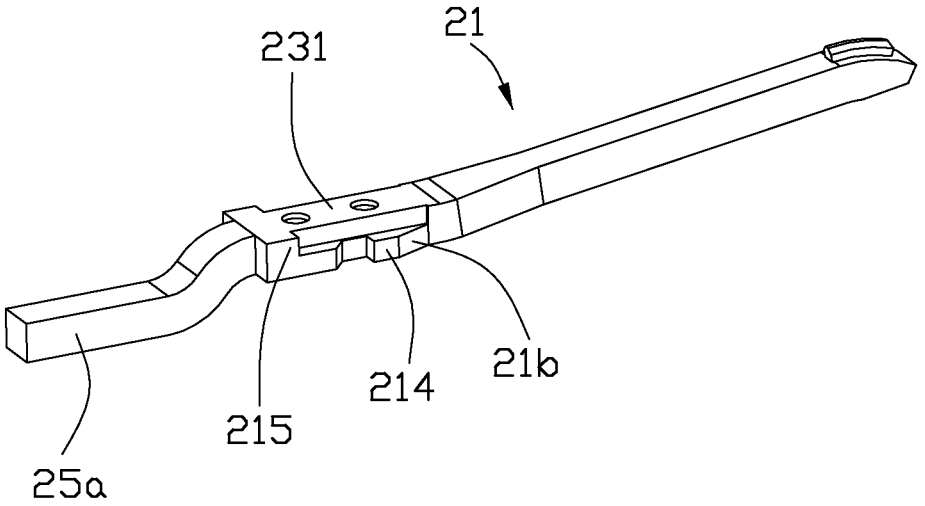
FIG. 5 is a perspective view of a first terminal of the card edge connector shown in FIG. 1.
Figure 6:
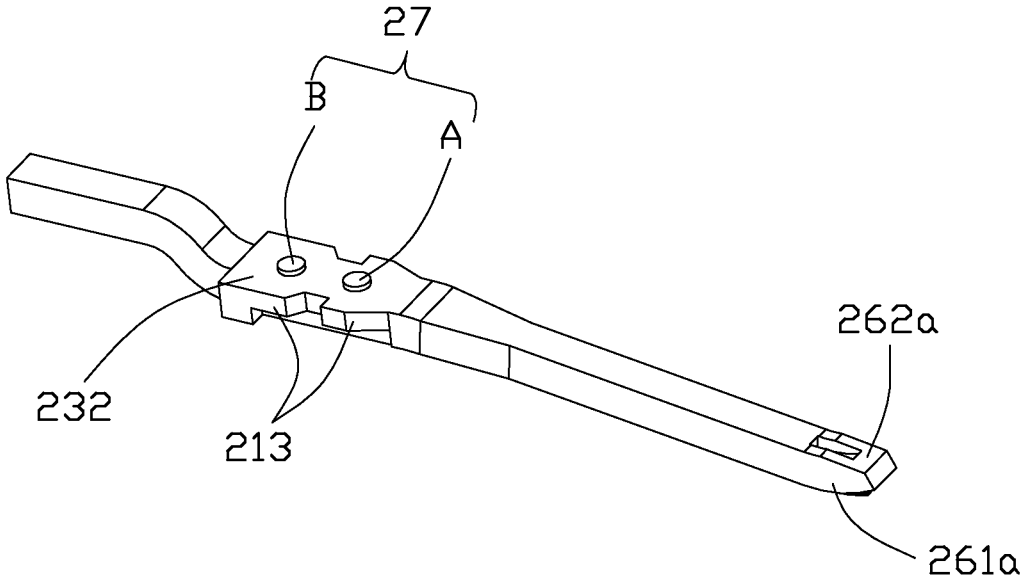
FIG. 6 is another perspective view of the first terminal shown in FIG. 5.
Figure 7:
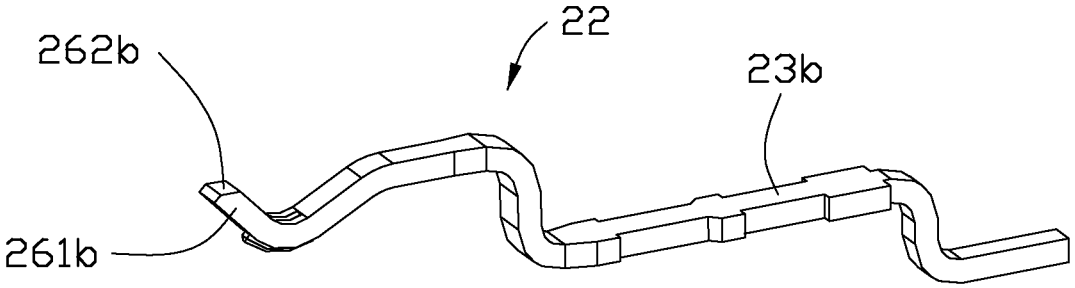
FIG. 7 is a perspective view of a second terminal of the card edge connector shown in FIG. 1.

Referring to FIG. 2 to FIG. 4, the insulative housing 1 defines a base portion 14 connecting the first and second sidewalls 11, 12, and the receiving slot 101 defines a pair of inner surfaces 109 opposite to each other. The conductive terminals 2 include a plurality of first terminals 21 and a plurality of second terminals 22, the first terminals 21 are assembled to the first sidewall 11 from a front face of the insulative housing 1 and the second terminals 22 are assembled to the second sidewall 12 from a rear face of the insulative housing 1. The front edge of the second sidewall 12 is an inclined surface 102, and the front edge of the first side wall 11 is an recessed surface 103, which is easier to make the electronic card inserted into the receiving slot 101. The first sidewall 11 defines a circuit board mounting surface 111.

Each conductive terminal 2 includes a retaining portion 23*a*, 23*b*, a contacting arm 24*a*, 24*b*, extending into the receiving slot 101 from the retaining portion 23*a*, 23*b*, and a soldering portion 25*a*, 25*b*, extending outside of the insulative housing 1. The contacting arm 24*a* of the first terminal 21 extends obliquely to the receiving slot 101 from the retaining portion 23*a*, and the soldering portion 25*a* of the first terminal 21 extends outside of the rear face of the insulative housing 1. The contacting arms 24*a*, 24*b*, define projecting ribs 26*a*, 26*b* projecting in the receiving slot 101 to form the contacting portions connecting the electronic card, respectively, and the contacting portions of the first terminal 21 and the second terminal 22 are aligned with each other in a vertical direction perpendicular to the mating direction.

Referring to FIG. 2 to FIG. 7, the contacting arms 24*a*, 24*b*, define free end portions 261*a*, 261*b*, to form the contacting portions. The part of the free end portions 261*a*, 261*b* facing to corresponding first and second sidewalls 11, 12, are cut away to form first surfaces 262*a*, 262*b*, and the first surfaces 262*a*, 262*b*, are parallel to the inner surface 109. The thickness of the free end portion 262*a*, 262*b* of the conductive terminal 2 is smaller than other parts of the conductive terminal 2 in the vertical direction perpendicular to the mating direction. When the electronic card is inserted into the receiving slot 101, the contacting portions 26*a*, 26*b*, of the conductive terminals 2 are pressed against by the electronic card to make the free end portions 261*a*, 261*b*, of the contacting arms 24*a*,24*b*, moving towards to the terminal slots 104. The thinned design of the free end portion 261*a*, 261*b* can protect the free end portion 261*a*, 261*b*, of the conductive terminals 2 from scratching the insulative housing 1 when the free end portion 261*a*, 261*b*, pressed against and reduce the space occupied by the conductive terminals 2 in the receiving slot 101, which is conducive to the thinned trend of the card edge connector. The retaining portion 23*b* of the second terminal 22 is higher than the contacting arm 24*a* of the first terminal 21 but lower than the contacting arm 24*a* of the second terminal 22.

A pair of wing portions 213 are formed by both sides of the retaining portion 23*a* of the first terminal 21 thinned and each defines a thinner portion 214 far away from the soldering portion 25*a* and a stopping portion 215 adjacent to the soldering portion 25*a*, each thinner portion 214 defines an obliquely guiding surface 21*b* located in front thereof. The first sidewall 11 defines a plurality of terminal slots 104 running through the front face of the insulative housing 1 and each terminal slot 104 defines a pair of fixed slots 105 located on two opposite sides thereof. The wing portion 213 is retained in the fixed slot 105 and the stopping portion 215 is abut against the front face of the insulative housing 1. The retaining portion 23*a* defines a first surface 231 facing to the receiving slot 101 and a second surface 232 facing to the terminal slot 104, a projecting portion 27 is formed by stamping from the first surface 231 to the second surfaces 232 and contacting with the terminal slot 104 so that the retaining portion 23*a* is not contacting with the terminal slot 104. The projecting portion 27 defines at least a first projecting point A and a second projecting point B, and the projecting point A, the second projecting point B and the contacting portion are located in a same straight line in the mating direction.

A fulcrum C can make the contacting arm 24 rotating when the contacting portion of the first terminal 21 is pressed against by the electronic card, at this time the length of the contacting arm 24 is a distance L1 from the contacting portion to the fulcrum C. The first terminal 24 is easy to be permanently deformed to lose elasticity if the distance L1 is short. Therefore, the retaining portion 23*a* of the first terminal 21 defines a projecting portion 27 and the length of the contacting arm 24 of the first terminal 21 is a distance L2 from the contacting portion to the first projecting point A. In other words, it can increase the elasticity of the first terminal 21 to add the projecting portion 27 so that it is conducive to increase the service life of the first terminal 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector, used for connecting an electronic card to a printed circuit board and comprising:

an insulative housing defining a front face, a mounting surface and a receiving slot running through the front face and extending along a longitudinal direction with a key disposed therein; and a plurality of conductive terminals retained in the insulative housing and each defining a contacting arm extending into the receiving slot along a mating direction perpendicular to the longitudinal direction and a soldering portion extending outside of the insulative housing; wherein the contacting arm of each conductive terminal defines a free end portion located in the receiving slot and with a contacting portion disposed thereon, the thickness of the free end portion in a vertical direction perpendicular to both the longitudinal direction and the mating direction is smaller than the thickness of other parts of the contacting arm; wherein the insulative housing defines a first sidewall and a second sidewall located in opposite sides of the receiving slot and a base portion connecting the first and second sidewalls, the conductive terminals include a plurality of first terminals located in the first sidewall and a plurality of second terminals located in the second sidewall; wherein the first terminal defines a retaining portion fixed in the first sidewall and the soldering portion extending outside of front face of the insulative housing, the second terminal defines a retaining portion fixed in the base portion, the contacting arm of the first terminal extends into the receiving slot from the retaining portion and the soldering portion of the second terminal extends outside of the rear face of the insulative housing; wherein a front edge of an inner surface of the second sidewall is an inclined surface, and a front edge of an inner surface of the first sidewall is an recessed surface; wherein the retaining portion of the second terminal is higher than the contacting arm of the first terminal but lower than the contacting arm of the second terminal in the vertical direction.

2. The card edge connector as described in claim 1, wherein the first sidewall define a plurality of terminal slots running through the front face of the insulative housing, each terminal slot defines a pair of fixed slots running through the front face of the insulative housing in two opposite sides thereof, the retaining portion of the first terminal defines a pair of wing portions located on two sides thereof, each wing portion is retained in the fixed slot and defines a thinner portion and a stopping portion abutting against the front face of the insulative housing.

3. The card edge connector as described in claim 2, wherein the retaining portion is stamped to form a projecting portion disposed in the terminal slot, and the wing portions are located on both sides of the projecting portion.

4. The card edge connector as described in claim 1, wherein the thinner free end portion is formed by part of the free end portion facing to the insulative housing being cut away, and which provides a first surface in the thinner free end portion.

5. The card edge connector as described in claim 4, wherein the receiving slot defines two inner surfaces opposite to each other and parallel to the first surface of the contacting arm.

6. The card edge connector as described in claim 5, wherein the free end portion of the contacting arm defines a projecting rib projecting in the receiving slot, and the projecting rib is defined as the contacting portion for contacting with the electrical card.

7. A card edge connector, used for connecting an electronic card to a printed circuit board and comprising:

an insulative housing defining a front face, a mounting surface, a receiving slot running through the front face in a front-to-back direction, and extending along a longitudinal direction perpendicular to said front-to-back direction, opposite upper and lower sidewalls located in opposite sides of the receiving slot, the housing providing a plurality of terminal slots running through the front face and communicating with the receiving slot in a vertical direction perpendicular to both said front-to-back direction and said longitudinal direction; and a plurality of conductive terminals stamped from sheet metal and retained in the lower sidewall, each of said terminals defining a retaining portion fixed in the terminal slot, a contacting arm upwardly and obliquely extending from the an inner end of the retaining portion into the receiving slot along the front-to-back direction, and a soldering portion extending out of the insulative housing; wherein the retaining portion defines opposite first and second surfaces in a thickness direction which is parallel to the vertical direction, said first surface upwardly communicatively facing to the receiving slot while said second surface facing away from the receiving slot but toward an inner surface of the housing in the terminal slot, and the retaining portion provides at least one projection on the second surface to abut against an inner surface of the housing in the terminal slot: wherein each terminal slot defines a pair of fixed slots running through the front face of the insulative housing in two opposite sides thereof, the retaining portion of the terminal defines a pair of wing portions located on two sides thereof, and each wing portion is retained in the fixed slot and defines a thinner portion, and the retaining portion further defines a stopping portion in front to the thinner portion to abut against the front face of the insulative housing.

8. The card edge connector as described in claim 7, wherein the projection is provided by punching the retaining portion from the first surface to the second surface.

9. The card edge connector as described in claim 7, wherein said retaining portion further includes another projection on the second surface, spaced from said projection in the front-to-back direction.

10. A card edge connector comprising:

an insulative housing having opposite first and second side walls to form therebetween a central slot extending along a longitudinal direction and forwardly communicating with an exterior in a front-to-back direction perpendicular to said longitudinal direction; and at least one row of contacts disposed in the housing in said longitudinal direction, each of the contacts made from sheet metal and including an immoveable retaining portion retained to the housing, an immovable soldering portion extending from one end of the retaining portion and exposed outside of the housing for mounting to a printed circuit board, and a deflectable contacting portion extending from the other end of the retaining portion and into the central slot; wherein the contacting portion extends in an oblique direction with a free end section, and a portion of said free end section facing an inner surface of the housing is removed to expose a new exterior surface on the free end section so as to provide a plane on the free end section confronting the inner surface of the housing instead of a sharp angle; wherein a front edge of an inner surface of the second sidewall is an inclined surface, and a front edge of an inner surface of the first sidewall is an recessed surface; wherein the retaining portion of the terminal in the second sidewall is higher than the contacting arm of the terminal in the first sidewall but lower than the contacting arm of the terminal in the second sidewall in the vertical direction.

11. The card edge connector as claimed in claim 10, wherein said row of contacts are located above the central slot, in each of said contacts the contacting portion is located in front of the retaining portion while the soldering portion is located behind the retaining portion in said front-to-back direction.

12. The card edge connector as claimed in claim 10, wherein said row of contacts are located below the central slot, and in each of said contacts the soldering portion is located in front of the retaining portion while the contacting portion is located behind the retaining portion in said front-to-back direction.

13. The card edge connector as claimed in claim 12, further including another row of contacts located above the central slot, wherein in each of said contacts the contacting portion is located in front of the retaining portion while the soldering portion is located behind the retaining portion in said front-to-back direction.

14. The card edge connector as claimed in claim 10, wherein the housing forms a plurality of terminal slots to receiving the corresponding contacts therein, and the inner surface of the housing is formed in each of said terminal slots.

15. The card edge connector as claimed in claim 14, wherein said contacts are assembled into the corresponding terminal slots, respectively.

16. The card edge connector as claimed in claim 15, wherein said row of contacts are located under the central slot, and in each of said contacts the soldering portion is located in front of the retaining portion while the contacting portion is located behind the retaining portion in said front-to-back direction.

* * * * *